United States Patent [19]

Stahlecker

[11] Patent Number: 4,481,760

[45] Date of Patent: Nov. 13, 1984

[54] WRAPPED YARN SPINNING MACHINE

[75] Inventor: Fritz Stahlecker, Bad Überkingen, Fed. Rep. of Germany

[73] Assignee: Hans Stahlecker, Suessen, Fed. Rep. of Germany; a part interest

[21] Appl. No.: 388,622

[22] Filed: Jun. 15, 1982

[30] Foreign Application Priority Data

Jun. 16, 1981 [DE] Fed. Rep. of Germany ..... 3123887

[51] Int. Cl.[3] ..... D02G 3/36; D02G 3/38

[52] U.S. Cl. ..... 57/18; 57/16

[58] Field of Search ..... 57/16–18

[56] References Cited

U.S. PATENT DOCUMENTS

| | | | |
|---|---|---|---|
| 4,226,077 | 10/1980 | Hilbert | 57/18 |
| 4,299,083 | 11/1981 | Igel et al. | 57/18 |
| 4,336,683 | 6/1982 | Bock et al. | 57/18 |
| 4,348,858 | 9/1982 | Rottmayr | 57/18 |
| 4,391,089 | 7/1983 | Billner et al. | 57/18 X |

*Primary Examiner*—John Petrakes

*Attorney, Agent, or Firm*—Craig & Burns

[57] ABSTRACT

A wrapped yarn spinning machine with several spinning units arranged in a row in side-by-side relationship on at least one side of the machine has a zone of the hollow spindle of each spinning unit, protected by being enclosed within a single closed housing that extends in the longitudinal direction of the machine. The closed housing is provided with a lid at each spinning unit at a front side of the machine. The lid has a height corresponding to at least the height of a side wall of the closed housing and through which binder thread spools, carried by the hollow spindle, can be removed. Bearing housings within which the spindles are rotatably supported are sealingly joined to the bottom of the closed housing at least in an operative condition of the hollow spindles, and the spindles have a portion which project out of the bearing housings in a direction toward take-up devices for the spun wrapped yarn, and which are driven by a drive, such as a belt drive extending in the longitudinal direction of the machine.

28 Claims, 15 Drawing Figures

1
A
16'
30
70
36
13'
28
17'
9'
10'
14'
18'
22
B
4
5
12'
2
11'
6
15
29
38
70
31
32
35
33
7
27
8
34
3
C

Fig. 7
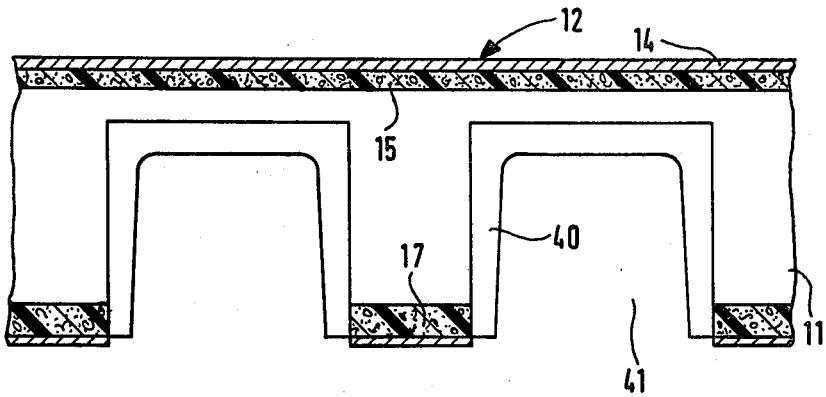
Fig. 9
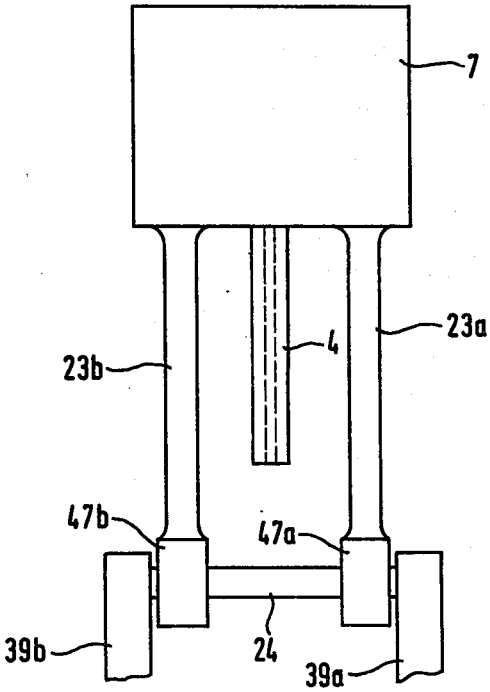
Fig. 8
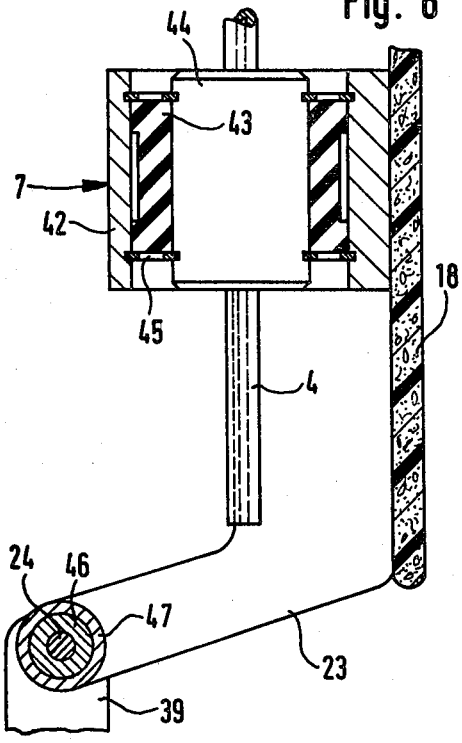
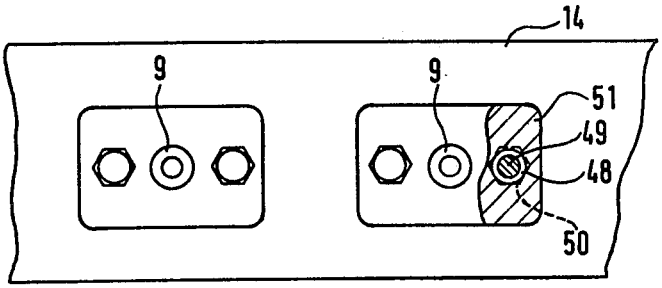
Fig. 10

Fig. 13
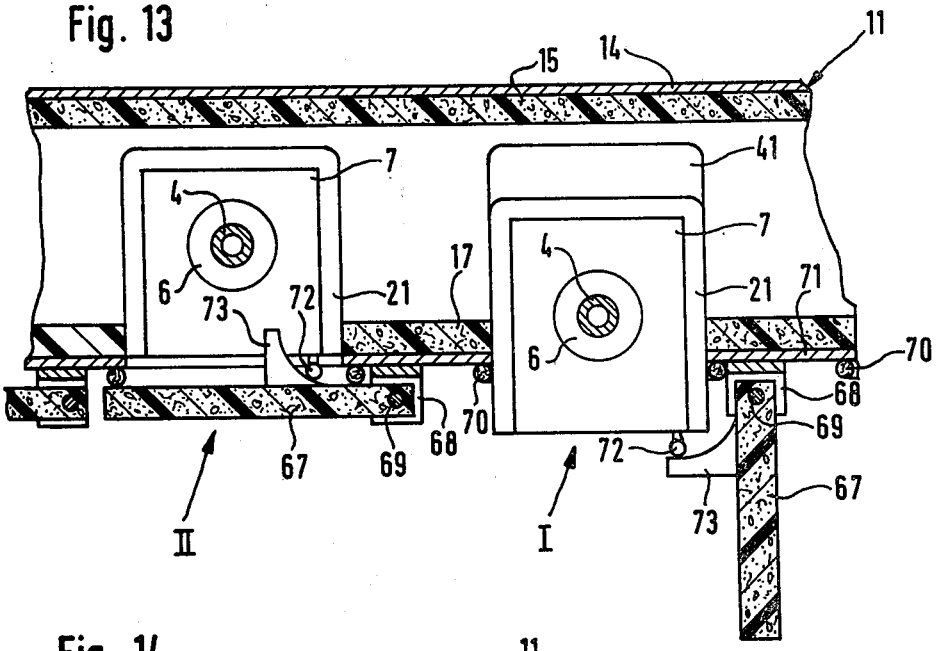
Fig. 14
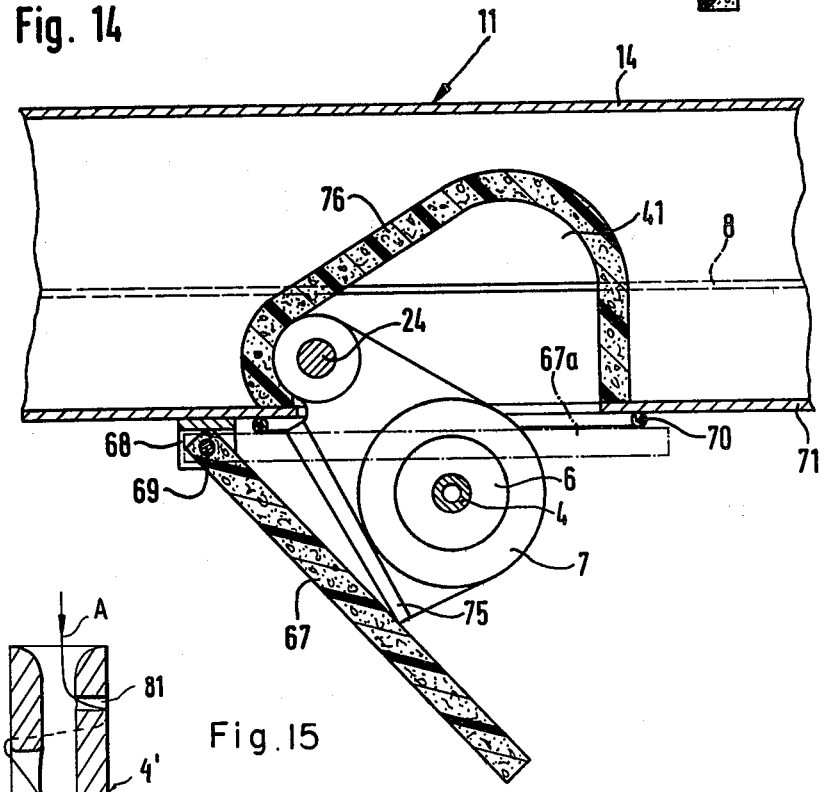
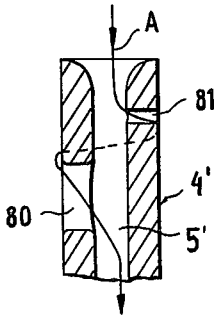
Fig. 15

WRAPPED YARN SPINNING MACHINE

BACKGROUND AND SUMMARY OF THE INVENTION

The invention relates to a wrapped yarn spinning machine with several spinning units arranged in a row in side-by-side relationship on at least one machine side, each of these units comprising a delivery device for a sliver; a hollow spindle following in the conveying direction of the sliver, this spindle carrying a binder thread in the form of a spool and being supported in a bearing box and driven with a drive means; and a subsequent take-up device for spun wrapped yarn, wherein the zone of the hollow spindle carrying the binder thread spool is protected by a closed housing, which latter is equipped at each spinning unit with a lid that can be moved out of the way to uncover the hollow spindle.

In a conventional wrapped yarn spinning machine (U.S. Pat. No. 4,226,077), each individual hollow spindle is provided in the region of the binder strand spool with its own enclosure shaped like a cylindrical tank. The hollow spindles are respectively supported within a bearing housing on swivel arm brackets that are pivotable about horizontal axles. The bottom of each enclosure is also supported on a respective one of these swivel arm brackets. Between the enclosures and the bearing housings, each hollow spindle is equipped with a whorl that extends into the bottom of the respective tank-shaped enclosure. The tank-shaped enclosures take care that the zone of the binder thread and especially the balloon of the binder thread, which is being formed, are protected against airborne fibers which can be expected in any spinning shop and are produced, for example, by the delivery device for the wrapped yarn spinning machine proper. The enclosures thus avoid the danger that the fly fibers are caught by the balloon of the binder thread, whereby they could be tangled up as wads or so-called "flags". These "flags" would result before long in breakage of the binder thread since they adhere to the site of largest diameter of the balloon and are not entrained.

The measures taken in the conventional type of construction for protecting the binder strand spools are, however, very expensive and not yet fully satisfactory in their result. Since the whorl of the hollow spindles must be extended through the bottoms of the tank-shaped enclosures to the area of their bearing support on the swivel arm brackets, it is impossible to completely seal the enclosures in this region, for the reason that a relatively large amount of play must be left for tolerance purposes between the whorls and the bottoms. Moreover, a rather complicated and also heavy construction results, inasmuch as the tank-shaped enclosures must be pivoted together with the spindles. Since, in the conventional type of structure, the ingress openings for the hollow spindles are arranged in relatively close proximity to the delivery devices, namely, at a spacing which is smaller than the staple length, the lid of the cylindrical enclosures can only be removed after the hollow spindles have been swiveled out of the way. This requires two manipulations for uncovering the hollow spindles (i.e., first pivoting of the enclosures and, second, opening of the lids), and in this connection, it is also disadvantageous that the binder strand spools can be grasped for exchanging only from the topside of the tanks.

Accordingly, the present invention has as its principal object the construction of a wrapped yarn spinning machine of the type discussed hereinabove so that, with a low expenditure in designing and construction, the binder thread spool is securely protected against fiber fly while, additionally, the accessibility of the hollow spindles and especially of the zone of the binder thread spools, for exchanging the latter, is not impeded. This object has been attained in accordance with preferred embodiments, by combining the enclosures for the plurality of binder thread spools of one machine side into a single housing extending in the longitudinal direction of the machine, this housing being equipped, at each spinning unit, with a lid, arranged on the machine side, that has a height corresponding at least to the height of the sidewall of the box-like housing; by arranging silver feed tubes between the inlet openings of the hollow spindles and the delivery devices; and by sealingly connecting the bearing housings of the hollow spindles with the bottom of the housing, the spindles projecting from the bearing housings in the direction of the take-up devices and being driven in this zone by the drive means.

By the use of a stationary housing as the enclosure, a further objective is achieved in that the parts to be moved for servicing have a lower weight. By employing the sliver feed tubes extending from close proximity to the spindle within the enclosure to near the delivery device, greater constructional freedom is attained, especially regarding the distance of the hollow spindles from the delivery devices, so that accessibility to the binder thread spools is improved, particularly in conjunction with the large-area lid provided. Due to the sealed connection of the bearing housings to the bottom of the housing, a perfect, no-gap seal is also ensured in this region. The provision of the drive unit underneath the bearing housings results in a clear, segmented subdivision, wherein the sector in which spinning technology is performed is separated from the drive-performing area. Additionally, an optically pleasing, compact appearance is obtained for the entire machine.

These and futher objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 7 is a horizontal section through a case enclosing the hollow spindles in the zone of the binder thread spools, wherein the hollow spindles and the lids have been omitted;

FIG. 8 is a vertical section through a spindle bearing for a pivotably mounted hollow spindle;

FIG. 9 is a front view of the spindle bearing housing according to FIG. 8;

FIG. 10 is a top view of a housing enclosing the binder thread spools showing an adjustable arrangement for the silver feed tubes;

FIG. 13 shows a horizontal section through two spinning units according to FIG. 12;

FIG. 14 shows a horizontal section through a further embodiment of a spinning unit of a wrapped yarn spinning machine, wherein the hollow spindles and lids are swingable about separate vertical axles; and FIG. 15 is a partial sectional view of the top of modified spindle.

DETAILED DESCRIPTION OF THE PREFERRED EMBODIMENTS

Figure 1:
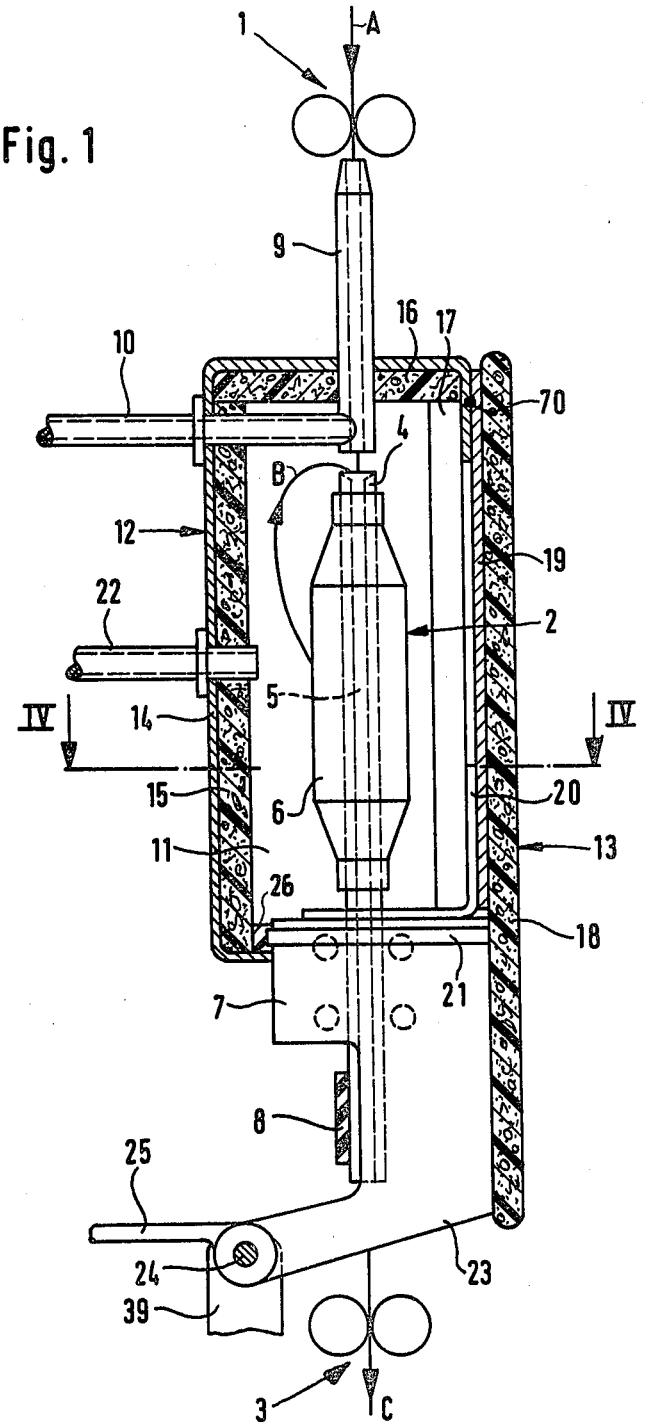
FIG. 1 is a vertical section through a spinning unit of a wrapped yarn spinning machine in accordance with a preferred embodiment of the present invention, shown in its operating condition.

The wrapped yarn spinning unit of FIG. 1 comprises a delivery device 1 (of which only two feed rollers are shown), a twisting element 2 and take-off device 3. The delivery device 1 feeds a sliver A to be wrapped by spinning to the twisting element 2, in the zone of which the sliver A is wrapped with a binder thread B. The twisting element 2 is followed by the take-off device 3, of which only two take-off rolls are illustrated; this device withdraws the finished wrapped yarn and conveys same to a windup device (not shown). The wrapped yarn spinning machine comprises a plurality of such spinning units arranged in series side-by-side on each machine side.

The twisting element 2 comprises a hollow spindle 4 provided with an axial bore 5 into which the sliver A is introduced. A spool 6 with the binder thread B is placed on the hollow spindle 4 for rotation therewith. This binder thread is, likewise, introduced into the inlet orifice of the hollow spindle 4. The hollow spindle 4 is supported in a bearing housing 7 from which the hollow spindle 4 projects in the downward direction. A tangential belt 8 engages the part of the spindle 4 that projects from the bearing housing 7 as the drive means therefor. This one belt 8 serves for driving all of the hollow spindles of one side of the machine. The tangential belt 8 is stressed by means of pressure rolls in a direction toward the hollow spindles 4 (in a manner not shown in detail).

The zone of the hollow spindles 4 carrying the binder thread spools 6 is enclosed by a case or housing 11, which extends across the full longitudinal extension of the machine and encloses all binder thread spools 6 of one side of the machine. This housing 11 extends, in a way not shown in detail, to the machine heads containing the drive means and auxiliary devices and respectively constituting an end wall closing off the housing 11. It is also possible, in housing of a machine consisting of several sections, to limit the length of housing 11 to one or more sections.

The housing 11 comprises a sheet-metal profile 14 that is bent into a C-shape for forming the rear wall, the bottom, and the top of the case 11 and so as to be open toward the front side of the machine (on the right in FIG. 1). The edges of the C-shaped sheet-metal profile 14, which edges are bent at an angle in the upward and downward directions, can be joined together by welded-on sheet-metal struts or webs 36, while leaving generous openings in the zone of the binder thread spools, so that the profile 14 is rigidified. The inner walls of the profile 14 are lined with panels 15, 16, 17, and 26 (FIG. 3) of a noise-attenuating material; these panels can consist especially of glued-on hard-foam plates. The panels 17, likewise, exhibit generous cutouts in the zone of the individual hollow spindles 4 or of the binder thread spools 6. These cutouts are made to be markedly wider than the maximum diameter of the binder thread spools 6.

The bearing housings 7 of the hollow spindles 4 are integrated into the bottom of the housing 11, which is equipped with cutouts 41 corresponding to the bearing housings 7 (see FIG. 7). The bearing housings 7 project into these cutouts 41 with their upper rims. The bearing housings are bordered by an elastic sealing element 21 which, in the closed condition, contacts, for example, the edge of the corresponding cutout of the panel 26 covering the bottom of profile 14.

Figure 2:
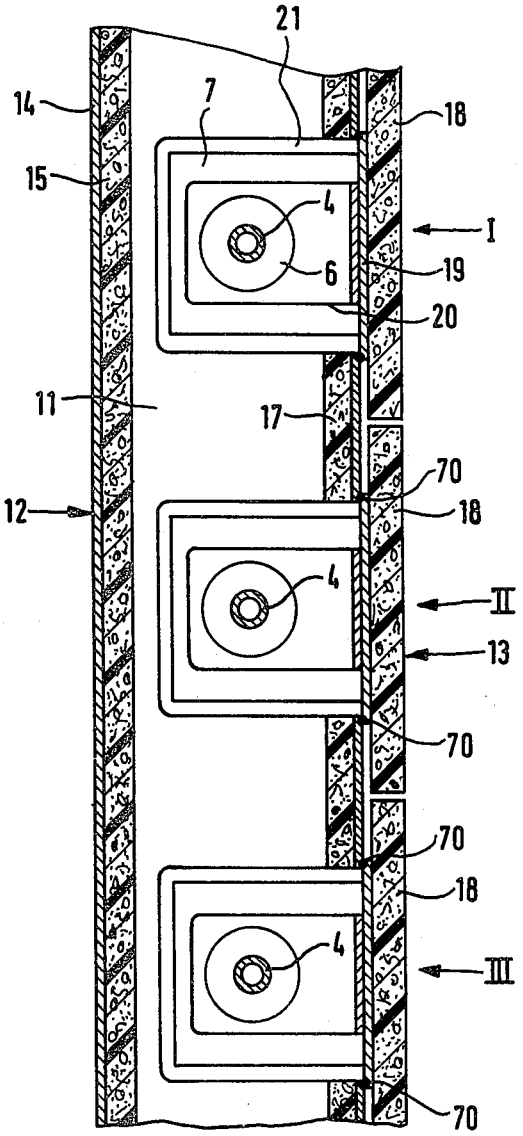
FIG. 2 is a horizontal section along line IV—IV of FIG. 1.
Figure 3:
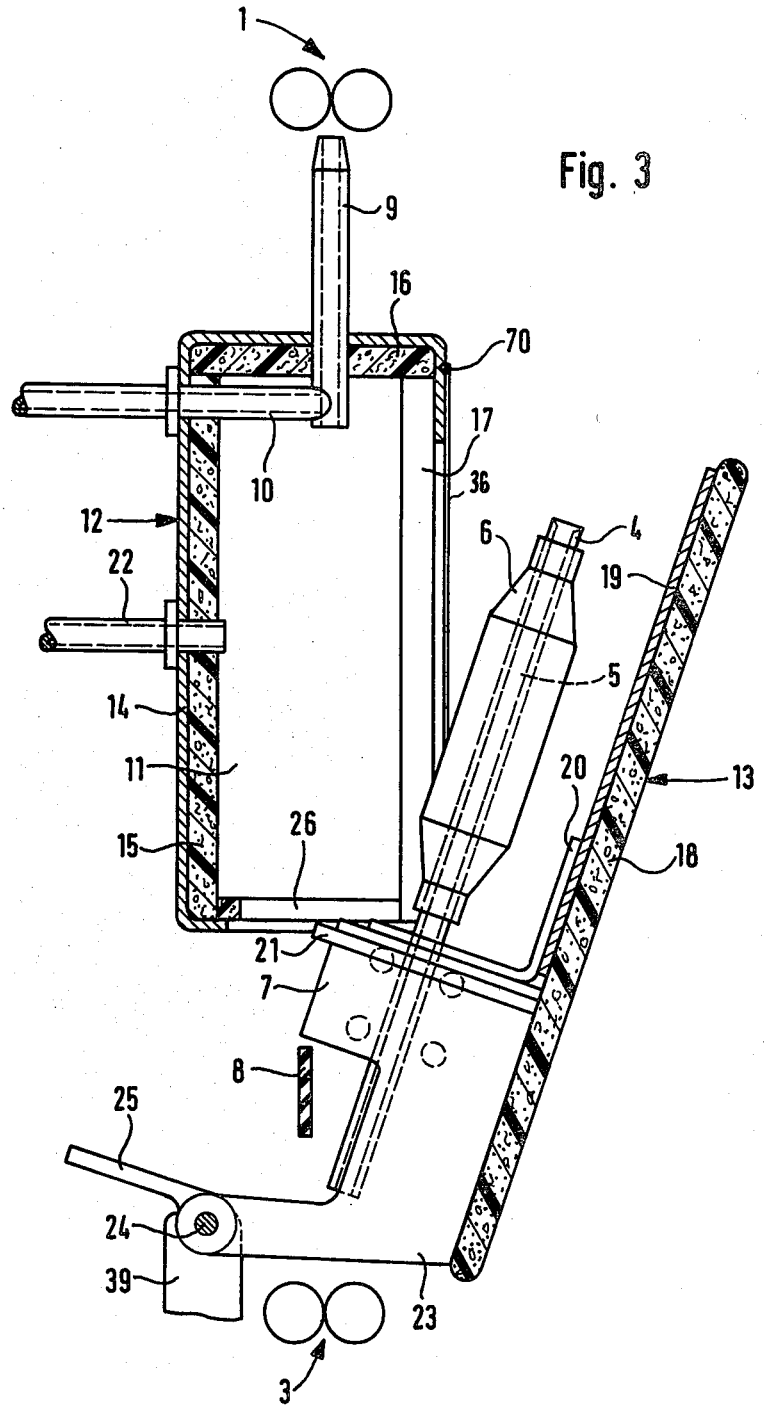
FIG. 3 shows the spinning unit of the spinning machine according to FIG. 1 in its inoperative condition with the hollow spindle being swung out of the way.

The bearing housings 7 of the hollow spindles 4 are mounted, with an arm 23, to be pivotable about a horizontal shaft 24, which is located underneath the housing 11 and the tangential belt 8, in the zone of the rear wall of the housing 11, and extends in the longitudinal direction of the machine. The pivot shaft 24, which can extend over the entire spinning machine, is carried by holders 39 of the machine frame. The arm 23 has an operating arm 25 that extends past the pivot shaft 24 and is engaged by an actuating mechanism in a manner not shown in detail; this actuating mechanism, if a thread break occurs as determined by a broken-end detector (not shown), swivels the spindle bearing housing 7 with the respective hollow spindle 4 into the inoperative position (FIG. 3). During this swiveling of the bearing housings 7, the hollow spindle 4 clearly exits from the interior of the housing 11, at least with its end facing the delivery device 1 (namely, the inlet orifice end), so that the spool 6 with the binder thread, mounted on the hollow spindle 4, is readily accessible and, if necessary, an empty bobbin tube can be replaced by a full bobbin 6. During the outward pivoting of the hollow spindle 4 and spool 6, the housing 11 is opened. On the front side of the machine from which the hollow spindle 4 is swung out, the housing is covered by a lid 13 which, in the operating condition, seals the opening of housing 11 with the aid of sealing strips 70. The lid 13, in the embodiment of FIGS. 1-3, is subdivided into a plurality of sections, one for each cutout in panel 17. Each section of lid 13 comprises, respectively, one plate 19 which is mounted to an angle bracket 20 that is joined to the topside of the bearing housing 7.

A panel 18 of a noise-damping material, especially a rigid foam material, is attached to the plate 19 on the outside; this panel is extended, in the downward direction, to the arm 23 of the bearing housings 7 and, thus, also shields the zone of the bearing housings 7 and of the tangential belt 8. The panels 18 project, in the longitudinal direction of the machine, past the width of the bearing housings 7 so that they adjoin the panels 18 of the adjacent sections of lid 13 while leaving a narrow gap (FIG. 2). Thereby, a smooth, compact appearance is offered from the front side of the machine or from the opening side.

The spacing between the inlet orifices of the hollow spindles 4 in the interior of the housing 11 and the delivery rolls of the delivery device 1 is bridged by sliver feed tubes 9. Sliver feed tubes 9 are arranged coaxially in an extension of the hollow spindles 4, when they are in the operating position, and they are mounted to the topside portion of the profile 14. Suction lines 10 communicate with the sliver feed tubes 9 so that, if necessary, especially during the piecing step, the sliver feed tubes 9 are placed under a vacuum by means of these suction lines. The spacing of the suction lines 10 with respect to the entrance of sliver A into the sliver feed tubes 9 is so great that the air suction effect (which would act in a direction deviating from the travel direction of the sliver, if suction is made to bear at all during operation), takes place only after the fibers have already been somewhat bound up (temporarily), and thus strengthened, by means of yarn twisting, especially a false-twist rotation. Such a false-twist rotation is created in the sliver by the rotation of the hollow spindle and the associated friction forces, as well as the forces of the binding thread. However, to achieve a defined degree of false-twist, a modified spindle 4', wherein sliver A passes from passage 5' out through aperture 81 around the spindle and back into passage 5' via opening 80 (FIG. 15), is advantageous. In this connection, it is important that an air flow is obtained in the conveying direction of the sliver feed tubes 9. To maximally prevent air from also being sucked in from the end of the sliver feed tubes 9 facing away from the delivery device 1, the sliver feed tubes 9 can be sealed, at their end lying opposite to the hollow spindle 4, by means of an insert or a cap, leaving a small aperture, as illustrated, for example, by cap 57 in FIG. 11. By means of the suction lines 10, any fly which may be produced can be removed by suction before reaching the interior of the housing 11.

The housing 11 is tightly sealed with respect to the outside so that the binder thread spools 6 are protected against penetration of fiber fly from the outside. In this connection, the bearings of the hollow spindles 4, accommodated within the bearing boxes 7, serve as sealing elements. To prevent air with fiber fly from entering, after all, at any possibly present leakage points, provision is made in the embodiment of FIGS. 1–3 to connect a compressed-air line 22 at one or several places of the housing 11, through which a slight excess pressure can be created in the housing 11. Consequently, at any leakage site, air can only be exhausted to the outside, and no air with fiber fly can enter. The housing 11 is dimensioned so that it encloses the binder thread spool 6 with a relatively small spacing in the upward and downward directions. The spacing of the sidewalls, constituted by the rear wall of profile 14 and panel 15, as well as by the lid 13 and the panels 17, is chosen so that the balloon of the binder thread B (which is formed during operation) cannot come into contact with these walls.

The housing 11 is suitably composed of several segments in the longitudinal extension of the machine, the length of such segments corresponding to the combined length of several of the individual spinning units I, II, III, etc., while the length of the panels 18 of lids 13 corresponds preferably to the division of the spinning units I, II, III, etc. (FIG. 2). In this case, parting line separations are produced in the zone of the junctions between the panels 18, and gaskets can be provided in the zone of these separations between the individual segments of housing 11.

Figure 4:
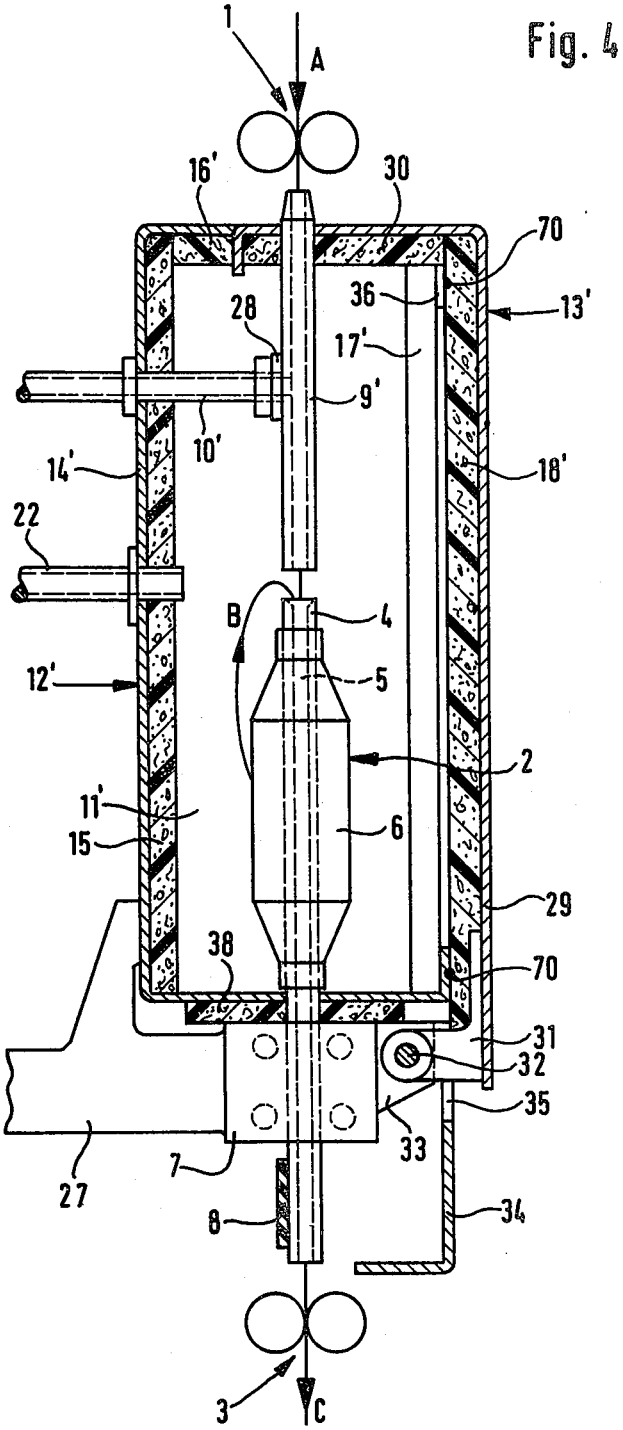
FIG. 4 shows a vertical section through a spinning unit of a wrapped yarn spinning machine in accordance with a modified embodiment of the present invention, in its operative condition, that uses a lid that is swingable independently of the hollow spindle.
Figure 5:
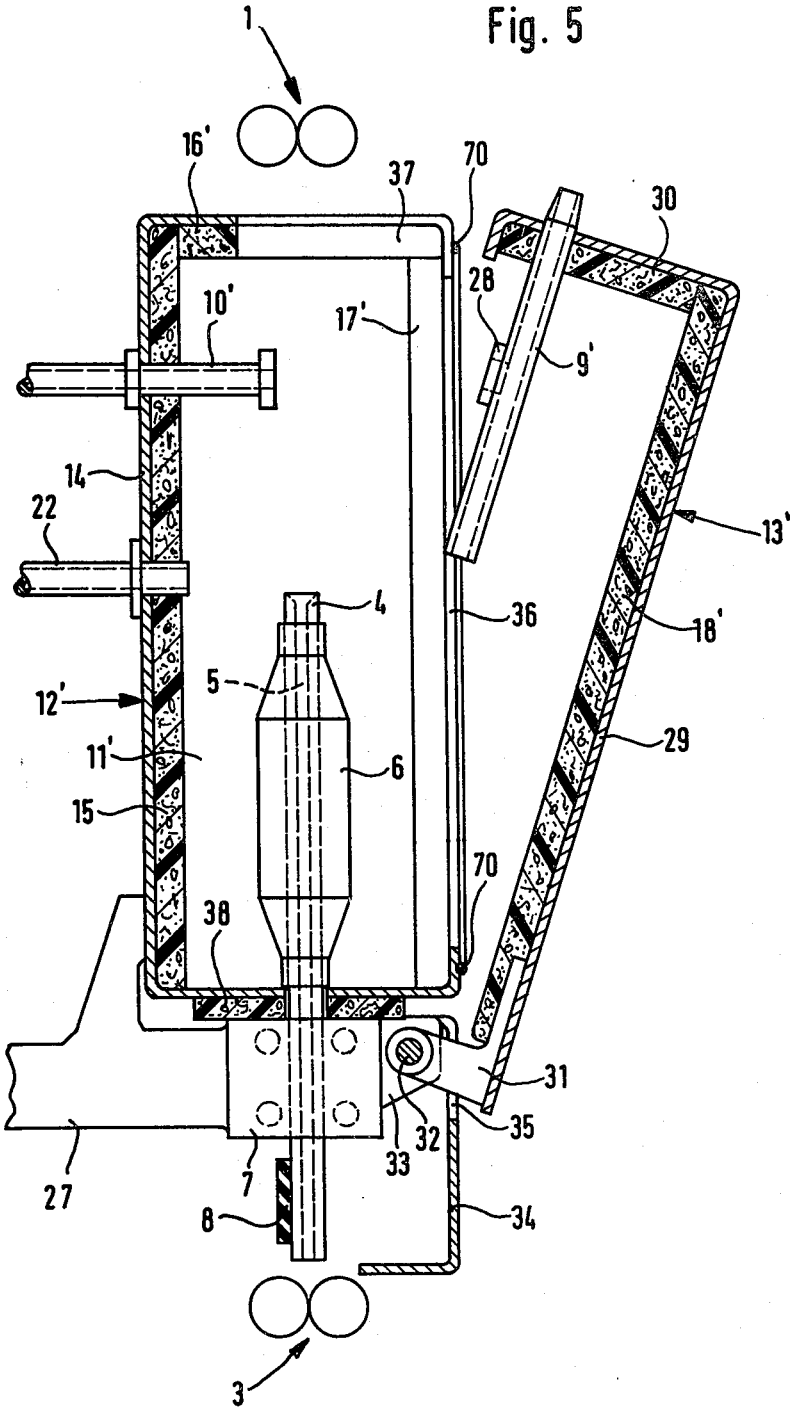
FIG. 5 shows a vertical section through the embodiment of FIG. 4, in its inoperative condition.
Figure 6:
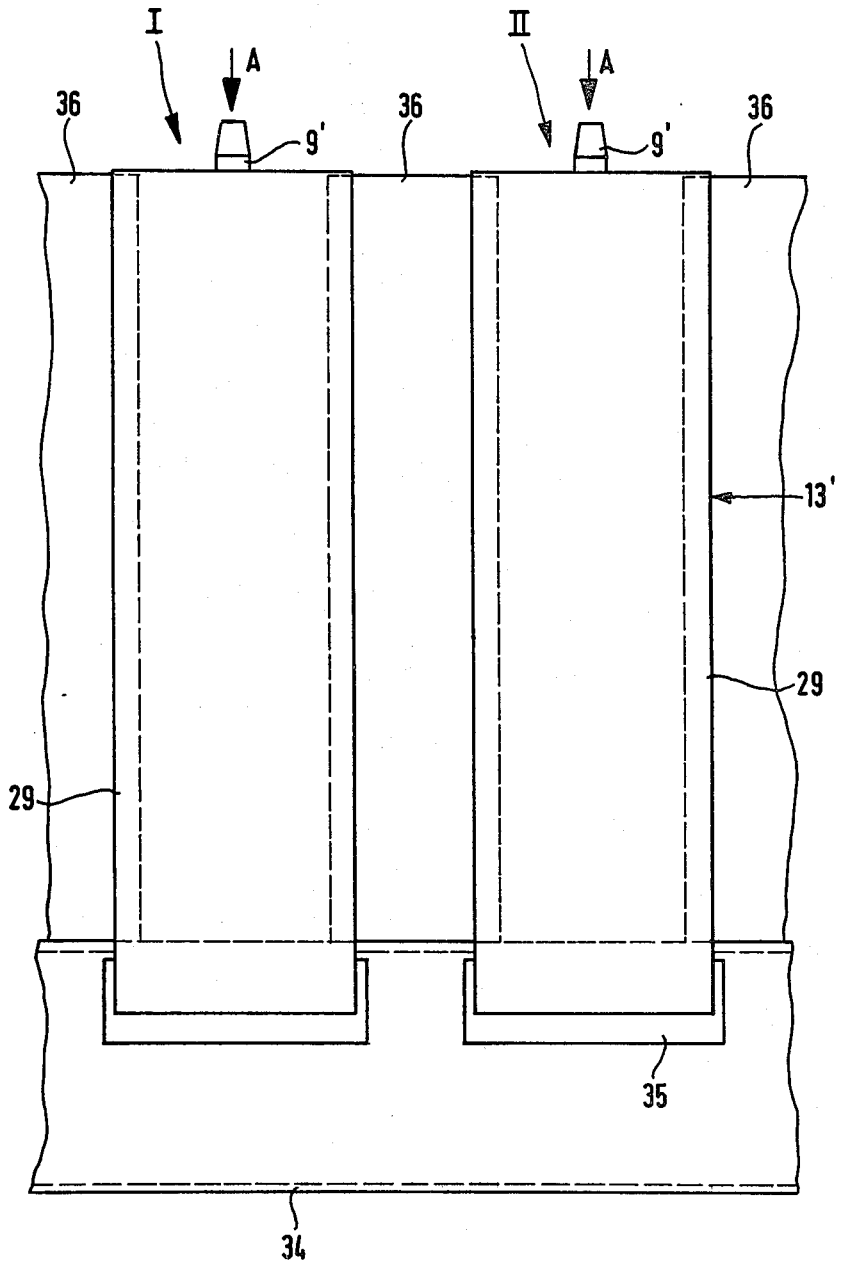
FIG. 6 shows a view of the machine face of the spinning unit of the wrapped yarn spinning machine according to FIGS. 4 and 5, in the operating condition.

In the embodiment of FIGS. 4–6, elements common to the embodiment of FIGS. 1–3 bear like reference characters, where unchanged, and bear a further prime (') designation where modified. The spindle bearing housing 7, along with the hollow spindles 4, are mounted to a corresponding fixed supporting arm of the machine frame 27; the hollow spindles are, likewise, driven by a tangential belt 8 at an end projecting downwardly from the spindle bearing housings 7. Also, in this embodiment, a continuously extending, closed housing 11' is provided which encloses the hollow spindles 4 in the region of the binder thread spools 6. The housing 11 which, as in the embodiment of FIGS. 1–3, has no metallic connection to the spindle bearing housings 7, comprises a fixed part 12' and a movable part, the lid, 13'. The fixed part 12' is made of a folded sheet-metal profile 14' attached to the machine frame and forming the bottom, the rear wall, and part of the topside of housing 11'. The rear wall and the topside are lined with panels 15' and 16' of a noise-damping material. In the same way, the front side is covered on the inside with a panel 17' of a noise-attenuating material, equipped with generous openings for making the hollow spindles 4 accessible. The same cutouts are also provided in the front wall, which is formed of individual webs 36 connecting the upwardly and downwardly angled edges of the profile 14' and being made, for example, of welded-on sheet-metal strips. In this embodiment, the sections of movable lid 13' are formed of an angularly folded sheet-metal profile 29, lined on the inside in its vertical part with a panel 18' of a noise-damping material, especially rigid foam material, and with a noise-damping panel 30. This angle profile 29 covers not only the opening in the region of the front side of the machine, but also a preferably U-shaped recess 37 in the zone of the topside of the housing 11'. The portion of the profile 29 covering this topside of the housing 11 carries, in this embodiment, a modified sliver feed tube 9' (described more fully below). Each lid section is mounted to a bracket-like holder 31 which is pivotable on a horizontally disposed pivot shaft 32 that is arranged on an extension 33 connected to the bearing housing 7. When a section of the lid 13' is pivoted into the inoperative position shown in FIG. 5, the hollow spindle 4, with the binder thread spool 6, is readily accessible, so that, for example, the binder thread spool 6 can be exchanged, if required. In this arrangement, in a manner not shown in detail, provision is made that the pivoting away of each section of the lid 13' takes place by way of an operating mechanism that is triggered by a broken-end detector in a way not illustrated in detail.

Suitably, the lid 13' is equipped with a device for arresting rotation of the respective hollow spindle 4, i.e., for example, with a lifter roller, articulated to each section of the lid 13', for lifting the tangential belt 8 off the hollow spindle 4 upon opening thereof. Optionally, a resiliently supported brake arm may also be connected with each section of lid 13', this brake arm contacting the hollow spindle 4 when a section of lid 13' is opened.

Underneath the housing 11', in the region of the front face of the machine, a cover plate 34 is provided which shields the zone of the bearing housing 7 and of the tangential belt 8 in a direction toward the front face of the machine. This cover plate 34 is provided with cutouts 35 through which the holders 31 project. In this embodiment, the sections of the lid 13' extend only to some extent past the width of the cutouts in the front wall 36 of housing 11' (see FIG. 6).

To seal the bottom, in this embodiment, a panel 38 of a nonmetallic material, especially of a noise-damping hard foam, is arranged between the topside of the spindle bearing housing 7 and the bottom of housing 11'. In this embodiment, the provision is, likewise, made that one or more connections 22 for compressed air are connected to the housing 11'. For the sliver feed tubes 9', suction lines 10' are also provided. However, unlike the fixed connection of line 10 to tube 9, suction lines 10' are separable from the sliver feed tubes 9', the tubes 9' being equipped with an elastic sealing ring 28.

With a stationary arrangement of the bearing housings 7 and thus of the hollow spindles 4, an adequate spacing must be provided between the delivery device 1 and the inlet end of the hollow spindle 4 in order to be able to withdraw the binder thread spools 6 in the upward direction and also to mount them from above. Therefore, in the embodiment of FIGS. 4–6, the height of the housing 11' has been appropriately increased. However, due to the use of sliver feed tubes 9', it is also possible to reduce the housing 11 substantially in its size and have it terminate, for example, closely above the compressed-air connection 22. In this case, the largest portion of the sliver feed tubes 9' and also the suction lines 10' would then lie outside of housing 11.

FIG. 7 illustrates a section through the fixed part 12 of the housing 11 similar to that as shown in FIG. 2. Here again, a C-shaped profile 14 is arranged, the inner walls of which are lined by panels 15 and 17, as well as by panels 16 and 26, which are not visible. The cutouts 41, into which the spindle bearing housings 7 are fitted, are encompassed by an elastic sealing profile 40 contacted by the spindle bearing housings 7 in the operating condition. In this case, the sealing profiles 21 can be omitted. The substantially U-shaped cutouts 41 slightly taper toward the rear wall of housing 11, so that friction during the inward and outward pivoting of the spindle bearing housings 7 is reduced. The same arrangement can also be suitably provided even if the spindle bearing housings 7 are lined with the sealing profiles 21.

FIGS. 8 and 9 show the construction of the spindle bearing housings 7 on an enlarged scale, as used in the embodiments of FIGS. 1–3 and FIGS. 12 and 13. The spindle bearing housing 7, first of all, comprises an annular bearing 44 containing the antifriction bearing elements for receiving the hollow spindle 4. Bearing 44 is connected, via an elastic bushing 43, to an outer bushing 42 of the spindle bearing housing 7. This outer bushing 42 is constructed integrally with the mounting arm 23, the latter of which consists of two arms **23*a* and 23*b*, between which the hollow spindle 4 extends. The bushing 43 is formed of a vibration- and noise-damping material, especially of rubber, and is connected by mounting rings 45 to the bearing 44 and the outer bushing 42. The mounting arms 23*a* and 23*b* are equipped with hubs 47*a*, 47*b*, respectively, and are pivotably arranged on the shaft 24 (which extends between legs 39*a*, *b* of holder 39) with the interposition of a ring 46** of a low friction vibration-damping material therebetween.

The sliver feed tubes 9 extend linearly and are arranged coaxially to the bores 5 of the hollow spindles 4. To provide adjustment of the sliver feed tubes 9 with respect to the hollow spindles 4, the former are attached by means of rectangular plates 51 to the profile 14 and/or to the top portion of lid 13 (FIG. 10). The rectangular plates 51, fixedly joined with the sliver feed tubes 9, are attached with two screws 49 to the topside of the housing, the passage holes 48 of the rectangular plates 51 having a larger diameter than the screw bolts, which latter are secured with nuts 50. Also, the passage bore in the top portion of the housing for the sliver feed tubes 9 has a larger diameter than the outer diameter of the sliver feed tubes 9. The nuts 50 and the screw heads cover, of course, the passage bores 48. In this way, a radial adjustability is provided for the sliver feed tubes 9.

Figure 11:
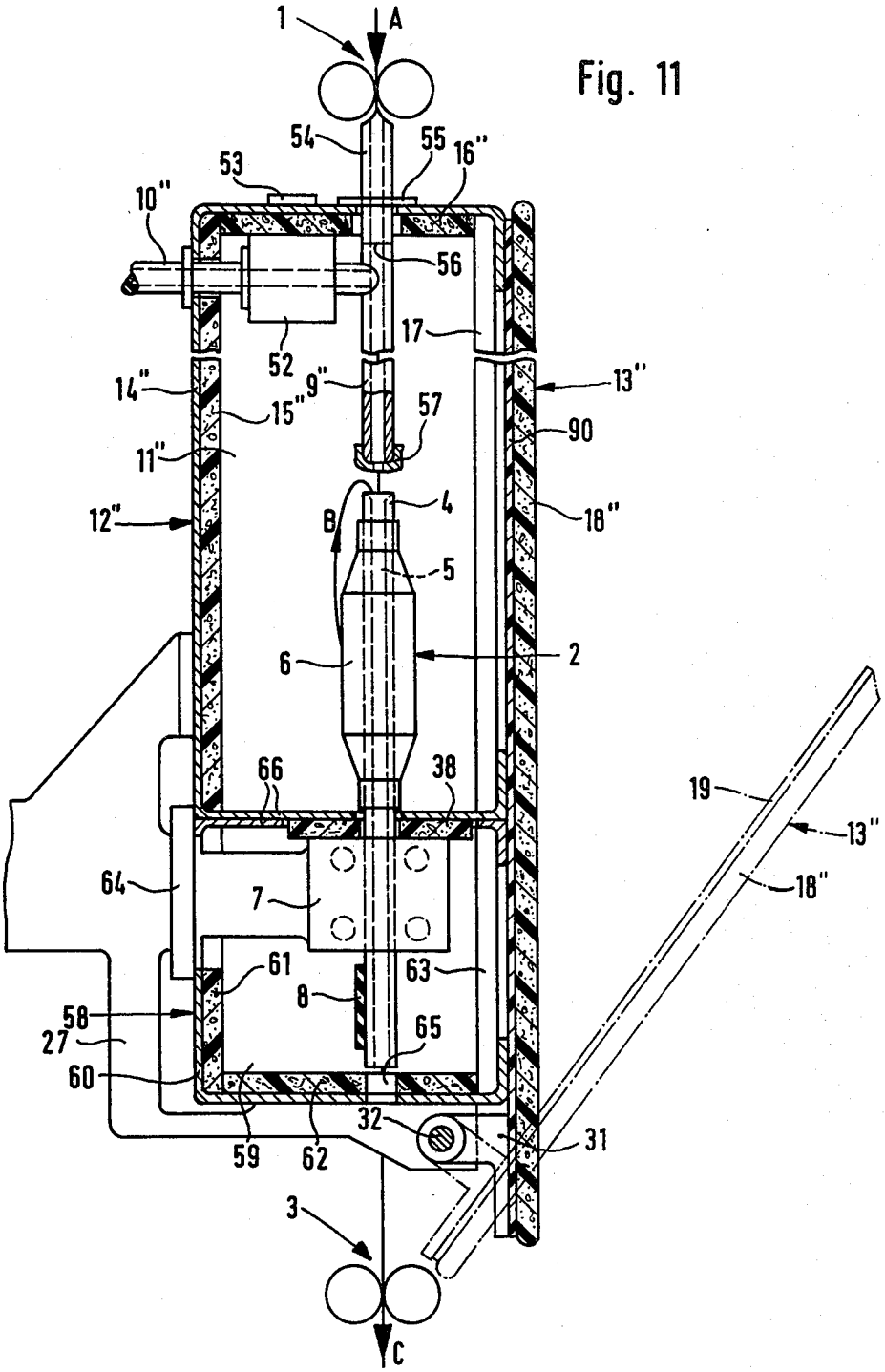
FIG. 11 is a vertical section through another embodiment of a spinning unit of a spinning unit of a wrapped yarn spinning machine in accordance with the present invention, with a lid that is swingable independently of the hollow spindle and having a second housing enclosing the bearing housings and a tangential belt.

In the embodiment of FIG. 11, the bearing housings 7 of the hollow spindles 4 are fixedly arranged. They are mounted to a flange 64 of the machine frame 27. Above the bearing housings 7, the part of the hollow spindle 4 is provided, which carries the binder thread spool 6. Below the bearing housings 7 is the part of the hollow spindles 4 driven by the tangential belt 8. The zone of the binder thread spools 6 is enclosed by a housing 11'' extending across the full longitudinal extend of the machine and constituted also in this embodiment by a stationary part 12'' and a lid portion 13''. The stationary part 12'' consists of a sheet-metal profile 14'' bent into a C-shape, the upper portion of the rear wall and the front side of this profile being covered by panels 15'', 16'', and 17'' of a noise-damping material, especially a rigid foam material. The C-shaped profile 14'' constitutes the bottom, the rear wall, and the topside of the case 11''. Generous openings are arranged in the front wall, which openings are covered by the lid 13'' which is pivotably articulated to the machine frame 27 on a horizontal pivot shaft 32. The lid 13'', in this embodiment, is comprised of a panel 18'', made preferably of a noise-damping material, especially a rigid foam material, which is mounted on the shaft 32 via a bracket-like holder 31. The inside of the lid 13'', facing into the housing 11'', is covered by a plate 90 of a rubber elastic material sealingly contacting the bent edges of the C-shaped profile 14'' and the wall portions laterally delimiting the opening. In correspondence with the embodiment of FIGS. 4–6, a nonmetallic panel 38, especially a rigid foam material, is arranged underneath the bottom of the housing 11, this panel sealing the region between the bottom of housing 11 and the bearing housings 7. This panel 38 can exhibit a disk-like configuration or a shape extending over several spinning units in the longitudinal direction of the machine.

In the embodiment of FIG. 11, the bearing housing 7 of the hollow spindles 4 and of the tangential belts 8 are accommodated within a second housing 59, immediately adjoining the first housing 11'' at 66. Housing 59 is made of a sheet-metal profile 60 that is, likewise, bent into a C-shape. This housing 59 also includes a stationary part 58, namely, the sheet-metal profile 60 bent into a C-shape, and the movable lid 13'' for housing 11'' extends past housing 59 and serves as a lid therefor, as well. The stationary part 58 is mounted to the machine frame 27. This part is, likewise, lined on the inside with noise-damping panels 61, 62, and 63 at the rear wall, the bottom, and the front side, respectively, except for the openings covered by the lid 13''. Openings are provided in the rear wall to connect the holders of the bearing housings 7 to the machine frame 27. In the zone of the bottom of this second housing 59, openings 65 are arranged in a coaxial extension of the hollow spindle 4, the finished wrapped yarn C being guided to the outside through these openings.

In the embodiment of FIG. 11, the sliver feed tubes 9'' are subdivided by a parting line or separating joint 56 into a stationary part 54 and a pivotable part. The stationary part 54 is attached with a flange 55 to the topside of the profile 14'' and projects into the gap between the rolls of the delivery device 1. The pivotable part of the sliver feed tubes is mounted within a holder 52 so as to be swivelable about a horizontal swivel axis and is connected to the topside of the profile 14'' by means of mounting elements 53. The lower end of the pivotal part of the sliver feed tube 9'' is closed off by a cap 57 which is provided with a relatively small bore for the passage of the sliver to minimize the flow of air through the feed tube 9'' in a direction opposite the direction of movement of the sliver. After opening the lid 13, the pivotable part of the sliver feed tubes 9 can be swung into a horizontal position so that the binder thread spool 6 can be pulled off in the upward direction and can be replaced by a new one. In this connection, the spacing of the pivot axis of the holder 52 from the inlet orifice of the hollow spindle 4 must be somewhat larger than the length of the binder thread spool 6. In this embodiment, provision is suitably made that the suction lines 10 adjoin the sliver feed tubes 9 in the zone of the pivot axis of the holders 52.

Figure 12:
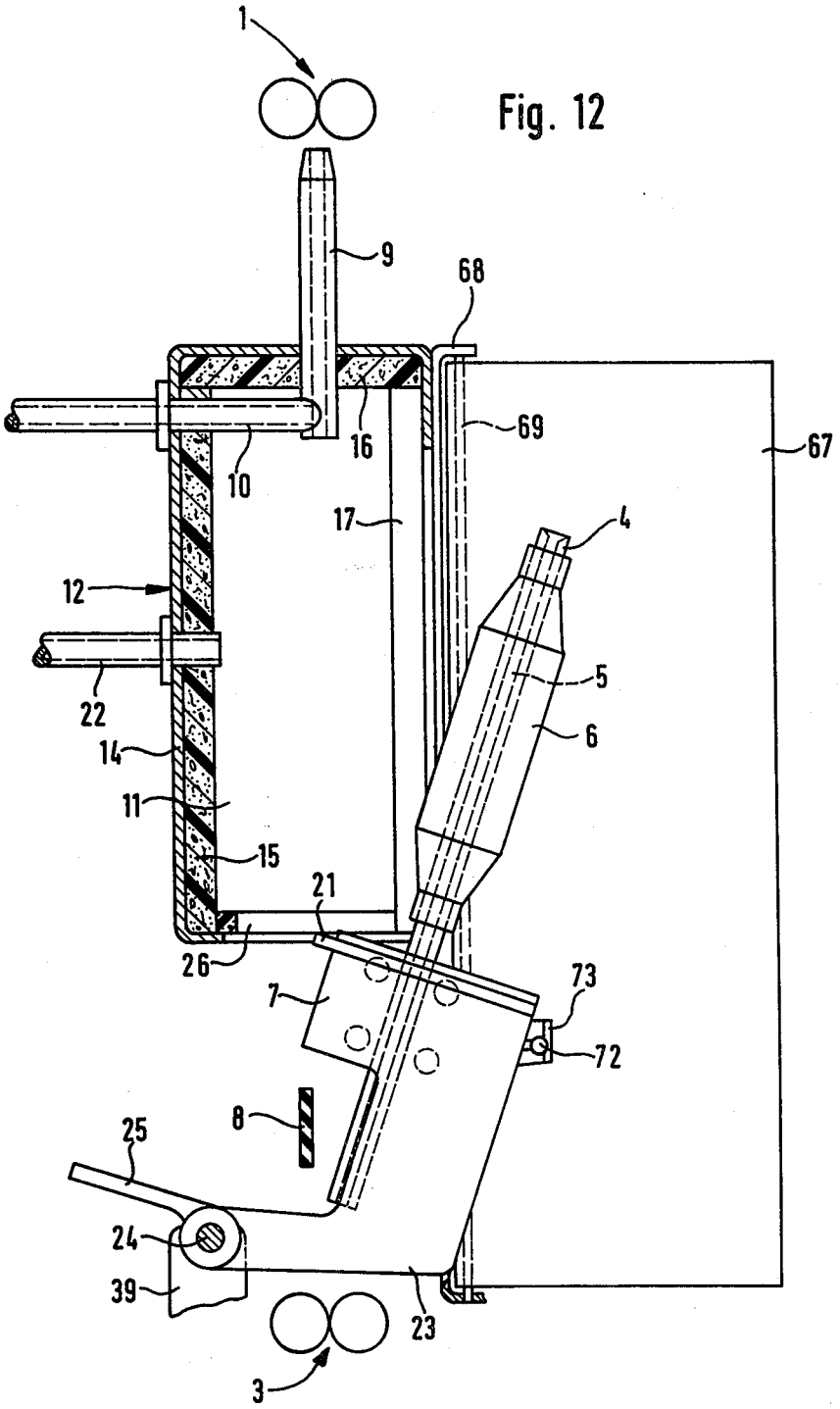
FIG. 12 is a vertical section through a spinning unit of yet another embodiment of a wrapped yarn spinning machine in accordance with the present invention, with hollow spindles that are pivotably arranged for swinging about a horizontal axle and with lids which can be flipped open about vertical axles.

The embodiment of FIGS. 12 and 13 corresponds in its basic construction to the embodiment of FIGS. 1–3. Here again, a housing 11 made of a C-shaped profile 14 and surrounding the zone of the binder thread spool 6 is provided, lines with panels 15, 16, 17, and 26 of a noise-damping material. The spindle bearing housings 7, bordered by an elastic sealing element 21, are mounted to be pivotable about a horizontal shaft 24, corresponding to FIGS. 1–3, in such a way that the hollow spindles 4 can be swung, with the binder thread spool 6, out of the housing 11, during which step they are detached from the tangential belt 8 so that the drive is interrupted.

The embodiment of FIG. 12 differs, however, from the embodiment of FIGS. 1–3 with regard to the construction of the lid. In the example of FIGS. 12 and 13, a lid 67 is provided made of a panel of noise-damping material, especially of a rigid foam material, which panel can be swung about a vertical shaft 69 supported in a holding profile 68 which is attached to the outside of front wall 71 of stationary profile 14. The holding profile 68 and the lid 67 extend over the height of the housing 11 and the bearing housings 7 located therebeneath, including the holding arms 23. A spherical dog 72 is arranged at the bearing housings 7, this dog abutting against a profiled stop 73 attached to the lids 67. Thereby, the pivoting motion of the bearing housings 7 about the horizontal pivot shaft 24 is translated into a pivoting motion of the lids 67 about their vertical pivot shaft 69. The lid is equipped with a closing spring in the zone of its vertical shaft 69 in a manner not illustrated in detail, this spring urging the lid 67 into the closed condition. The lid 67 thus closes automatically when the bearing housings 7 and the hollow spindles 4 are swung back into the operating position. Thus, this arrangement provides that the lid 66 is separated so that transmission of vibrations from the drive mechanism and the bearings of the hollow spindles 4 to the lid 67 is impossible. Consequently, a further improved noise protection is attained. This noise damping is also additionally enhanced by the sealing strips 70, by way of which the lids 67 are joined to the housing 11 and/or the profile 14.

The embodiment of FIG. 14 also provides that a lid, 67', which is pivotable about a vertical pivot shaft 69 in a mounting profile 68 that is mounted to front wall 71, is separated from the spindle bearing housings 7. In this embodiment, the spindle bearing housings 7, together with the hollow spindles 4 and the binder thread bobbin 6, can be swung out of the channel 11 about a vertically disposed pivot shaft 24, this channel is similar to that of the embodiment of FIGS. 12 and 13 being formed of a C-shaped profile 14 lined with noise-attenuating panels 15, 16, 17, and 26. The bottom of the channel 11 is equipped with a cutout 41' lined with an elastic sealing insert 76. The cutout 41 and the insert 76 correspond to the contour of the spindle bearing housings 7'', which latter forms together with the pivot shaft 24, a tightly sealing insert. This insert 76 is extended in the upward direction by a front wall 75, which latter is correspondingly sealed with respect to the lids 67' by means of sealing strips 70. With an automatic pivoting away from the bearing housing 7 with the hollow spindle 4 out of the housing 11, triggered by a thread break, the lid 67 is opened at the same time, this lid being, likewise, stressed in the closed position (dashed line portion 67*a*) by a torsion spring (not shown) arranged in the zone of its vertical shaft 69.

While I have shown and described various embodiments in accordance with the present invention, it is understood that the same is not limited thereto, but is susceptible of numerous changes and modifications as known to those skilled in the art and I, therefore, do not wish to be limited to the details shown and described herein, but intend to cover all such changes and modifications as are encompassed by the scope of the appended claims.

I claim:

1. A wrapped yarn spinning machine with a number of spinning units arranged in a row in side-by-side relationship on at least one machine side, each of these units comprising a delivery device for a sliver; a hollow spindle with an inlet orifice located downstream of said delivery device in a conveying direction of the sliver, a bearing housing for said spindle, a sliver feed tube between the delivery device and the spindle, said spindle carrying a binder thread in the form of a spool and being supported in said bearing housing, and a drive means for driving said spindle; and a take-up device, located downstream of said spindle in said conveying direction, for spun wrapped yarn, a closed housing means for protecting a zone of the hollow spindle carrying the binder thread spool, said closed housing means having a bottom and a side wall and being openable to uncover the hollow spindle; the zone of at least several of the units of one machine side being protected by said closed housing means which extends as integral housing in the longitudinal direction of the machine over said several units, said closed housing means including at each spinning unit a lid arranged on the front side of the machine and of a height corresponding to at least the height of the side wall of the closed housing means, the sliver feed tubes being arranged between the inlet orifices of the hollow spindles and the delivery devices, and the bearing housing of the hollow spindles being sealingly joined to the bottom of the closed housing means at least in an operative condition of the hollow spindles, said spindles having a portion projecting out of the bearing housings in a direction toward the take-up devices and being driven thereat by the drive means.

2. Wrapped yarn spinning machine according to claim 1, wherein the sidewalls of the housing means are located at a distance from the hollow spindles, which is larger than the diameter of a balloon of the binder thread formed during operation.

3. Wrapped yarn spinning machine according to claim 1, wherein the hollow spindles and their bearing housings are pivotably mounted with respect to the housing means in such a way that, with the lid open, at least an end of the hollow spindles facing the delivery device is movable out of the housing means.

4. Wrapped yarn spinning machine according to claim 3, wherein the pivotably mounted bearing housings of the hollow spindles are fitted into cutouts in the bottom of the housing means, and elastic sealing elements between the edges of the cutout and the bearing housings.

5. Wrapped yarn spinning machine with pivotally arranged bearing housings according to claim 3 or 4, wherein the lids are mounted on the pivotably arranged bearing housings.

6. Wrapped yarn spinning machine according to claim 1, wherein the hollow spindles and their bearing housings are fixedly arranged, and wherein the sliver feed tubes are mounted so that they can be pivoted away from the hollow spindles.

7. Wrapped yarn spinning machine according to claim 6, wherein the lids are coupled with means for interrupting the drive of the hollow spindles.

8. Wrapped yarn spinning machine according to claim 6 or 7, wherein the sliver feed tubes are connected to the lids, said lids forming part of the topside of the housing means and being mounted so as to be swingable away from the spindles.

9. Wrapped yarn spinning machine according to claims 1 or 2 or 3 or 4, wherein the lids are connected to the housing means so that they can be pivoted open about substantially vertical axes, and the bearing housing with the hollow spindles are arranged to be pivotable about substantially horizontal axes; and wherein transfer mechanisms are provided between the bearing housings and the associated lids, which transmit pivoting motion of the bearing housings to the lids for producing an opening and closing motion thereof.

10. Wrapped yarn spinning machine according to claim 1 or 2 or 3 or 4 or 6 or 7, wherein the lids are arranged side-by-side and cover a sidewall of the housing means in the longitudinal direction of the machine.

11. Wrapped yarn spinning machine according to claim 10, wherein the lids project beyond the housing means in a downward direction and cover an area of the bearing housings of the hollow spindles and of a tangential belt forming part of said drive means for driving the hollow spindles which run in the longitudinal direction of the machine.

12. Wrapped yarn spinning machine according to claim 11, further comprising second housing means, the bearing housings of the hollow spindles and the tangential belt being arranged in said second housing means.

13. Wrapped yarn spinning machine according to claim 12, wherein the lids cover the first-mentioned housing means and said second housing means.

14. Wrapped yarn spinning machine according to claim 13, wherein the sliver feed tubes project into the first-mentioned housing means and comprise two successive parts, wherein one of said parts of the sliver feed tubes is located in the first-mentioned housing means and is pivotable about a hoirzontal axis in a region of the top of the first-mentioned housing means.

15. Wrapped yarn spinning machine according to claim 1 or 2 or 3 or 4 or 6 or 7, wherein the sliver feed tubes project into the housing means and comprise two successive parts, wherein one of said parts of the sliver feed tubes is located in the housing means and is pivotable about a horizontal axis in a region of the top of the housing means.

16. Wrapped yarn spinning machine according to claim 1 or 2 or 3 or 4 or 6 or 7, wherein the inner surfaces of the housing means are lined with paneling means of a noise-damping material.

17. Wrapped yarn spinning machine according to claim 16, wherein said noise-damping material is a foam material.

18. Wrapped yarn spinning machine according to claim 1 or 2 or 3 or 4 or 6 or 7, wherein a compressed-air connection is connected to the housing means.

19. Wrapped yarn spinning machine according to claim 1 or 2 or 3 or 4 or 6 or 7, wherein the sliver feed tubes are arranged coaxially with respect to the hollow spindles.

20. Wrapped yarn spinning machine according to claim 19, wherein the sliver feed tubes are mounted so as to be adjustable in a radial direction relative to the housing means.

21. Wrapped yarn spinning machine according to claim 19, wherein the sliver feed tubes are connected to suction air connections.

22. Wrapped yarn spinning machine according to claim 21, wherein ends of the sliver feed tubes facing the hollow spindles are covered by a member having an opening, the inner diameter of which is smaller than that of the sliver feed tubes.

23. A wrapped yarn spinning apparatus comprising a delivery means for a sliver, a hollow spindle means following the delivery means in the conveying direction of the sliver and having an inlet opening, said hollow spindle means carrying a binding thread in the form of a spool, bearing housing means for rotatably supporting said hollow spindle means, drive means for said hollow spindle means, take-off means following said hollow spindle means for spun wrapped yarn, and means enclosing the hollow spindle means within the area of the binding thread spool including lid means movable for rendering accessible the hollow spindle means, said means enclosing the hollow spindle means including a side wall, said lid means corresponding at least approximately to the height of the side wall, and sliver feed tube means disposed between the inlet opening of the hollow spindle means and the delivery means.

24. An apparatus according to claim 23, in which said means enclosing the hollow spindle means includes a bottom, said bearing housing means being sealingly connected with said bottom, said hollow spindle means projecting out of the bearing housing means in the direction of the take-off means and being driven within said area by said drive means.

25. An apparatus according to claim 23 or 24, in which the side wall of the means enclosing said hollow spindle means has a distance to the hollow spindle means that is larger than the diameter of a balloon of the binding thread which forms during operation.

26. An apparatus according to claim 23, characterized in that the hollow spindle means together with its bearing housing means are pivotally supported relative to the means enclosing the hollow spindle means in such a manner that with an opened lid means at least the end of the hollow spindle means facing the delivery means is operable to be moved out of the means enclosing said hollow spindle means.

27. An apparatus according to claim 26, characterized in that the lid means is mounted at the respective pivotally arranged bearing housing means.

28. An apparatus according to claim 26 or 27, further comprising means for interrupting the drive of the hollow spindle means operatively connected with the lid means.

* * * * *